US011414793B2

(12) United States Patent
Benelli

(10) Patent No.: US 11,414,793 B2
(45) Date of Patent: Aug. 16, 2022

(54) ELASTIC CORE YARNS BASED ON LINEN, OR HEMP, OR OTHER MATERIALS, AND ELASTICIZED FABRICS THEREFROM

(71) Applicant: Paolo Benelli, Prato (IT)

(72) Inventor: Paolo Benelli, Prato (IT)

( * ) Notice: Subject to any disclaimer, the term of this patent is extended or adjusted under 35 U.S.C. 154(b) by 0 days.

(21) Appl. No.: 16/971,287

(22) PCT Filed: Feb. 19, 2019

(86) PCT No.: PCT/IB2019/051343
§ 371 (c)(1),
(2) Date: Aug. 19, 2020

(87) PCT Pub. No.: WO2019/159155
PCT Pub. Date: Aug. 22, 2019

(65) Prior Publication Data

US 2020/0378038 A1 Dec. 3, 2020

(30) Foreign Application Priority Data

Feb. 19, 2018 (IT) ..... 102018000002808

(51) Int. Cl.
*D02G 3/32* (2006.01)
*D02G 1/02* (2006.01)
(Continued)

(52) U.S. Cl.
CPC ..... *D02G 3/322* (2013.01); *D02G 1/02* (2013.01); *D02G 3/36* (2013.01); *D02G 3/38* (2013.01)

(58) Field of Classification Search
CPC ..... D02G 3/322; D02G 3/36; D02G 3/38; D02G 1/02
See application file for complete search history.

(56) References Cited

U.S. PATENT DOCUMENTS 2,203,622 A * 6/1940 Van Voorhis ..... B29D 99/0078 57/225
2,300,241 A * 10/1942 Van Voorhis ..... D02G 3/328 57/225
(Continued)

FOREIGN PATENT DOCUMENTS

JP 2008-297646 A 12/2008
WO 2008/130563 A1 10/2008
(Continued)

*Primary Examiner* — Shaun R Hurley
(74) *Attorney, Agent, or Firm* — Maschoff Brennan

(57) ABSTRACT

A method is provided for manufacturing an elastic core yarn in which a core comprises an elastic fiber and a continuous yarn arranged along the elastic fiber, and in which a covering yarn of such a natural material as flax, hemp, ramié, bamboo, jute, is helically wrapped about the core. A step of helically wrapping the core with the covering yarn is carried out in such a way that a number T of coils covering yarn is formed about a length unit of the elastic fiber larger than a predetermined minimum value depending on the linear mass density Nm of covering yarn, and that the covering yarn becomes twisted with a final twist direction "S" or "Z" that is opposite to an initial twist direction "Z" or "S", respectively. The step of wrapping is performed in a wrapping space enclosed within a container.

16 Claims, 2 Drawing Sheets

(51) Int. Cl.
*D02G 3/36* (2006.01)
*D02G 3/38* (2006.01)

(56) References Cited

U.S. PATENT DOCUMENTS 2,354,449 A * 7/1944 Alderfer ..... D02G 3/324 57/12
2,397,460 A * 4/1946 Bell ..... D04B 1/26 112/414
3,124,924 A * 3/1964 Smith ..... D02G 3/322 57/18
3,243,950 A * 4/1966 Hermes ..... D02G 3/324 57/12
3,504,410 A * 4/1970 Alexandre ..... D02G 3/328 28/156
3,527,045 A * 9/1970 David ..... D01F 6/70 57/225
3,609,953 A * 10/1971 Kitawaza ..... D02G 3/32 57/226
4,467,595 A * 8/1984 Kramers ..... D01D 5/08 264/210.2
4,470,250 A * 9/1984 Arenz ..... D02G 3/328 57/225
4,975,543 A * 12/1990 Saunders ..... B64D 3/02 114/253
6,293,079 B1 * 9/2001 Heinzle ..... D01H 7/88 57/129
6,581,366 B1 * 6/2003 Andrews ..... D02G 3/328 57/225
7,520,121 B2 * 4/2009 Teshima ..... D02G 3/32 57/236
7,665,288 B2 * 2/2010 Karayianni ..... D02G 3/441 57/3
10,407,804 B2 * 9/2019 Benelli ..... D02G 3/04
2003/0186610 A1 * 10/2003 Peters ..... D02G 1/165 442/327
2004/0128973 A1 7/2004 Morikawa
2007/0214765 A1 * 9/2007 Teshima ..... D02G 3/406 57/293
2013/0251974 A1 * 9/2013 Benelli ..... D02G 3/04 428/222
2013/0305788 A1 * 11/2013 Atmanspacher ..... D02G 3/36 66/178 A
2016/0024692 A1 * 1/2016 Yung ..... D03D 15/47 139/421
2021/0388538 A1 * 12/2021 Benelli ..... D02G 3/36

FOREIGN PATENT DOCUMENTS

WO 2012/056436 A2 5/2012
WO 2012/062480 A2 5/2012

* cited by examiner

ELASTIC CORE YARNS BASED ON LINEN, OR HEMP, OR OTHER MATERIALS, AND ELASTICIZED FABRICS THEREFROM

FIELD OF THE INVENTION

The present invention relates to a method for making elasticized yarns based on natural fibres, among which cotton, in particular such stiff natural fibres as linen, ramié, hemp, jute, bamboo. The invention also relates to fabrics products with the above elasticized yarns.

BACKGROUND OF THE INVENTION—TECHNICAL PROBLEM

Since some decades, elasticized fabrics made from elastic thread yarns of many kinds are used. The advantage of these fabrics is a high deformability of the items made therefrom. In particular, garments are made that do not hinder the movements of the limbs of the user, or conform themselves to these movements, thus generating a comfort sensation. This is particularly useful in underwear clothing or in sport and gym clothes, for particular use, but is also appreciated in everyday life situations such as sitting in a car, walking and whenever the joints are bent. Moreover, elasticized fabrics are used to make bandages, dressings and garments for treating wounds, sprains, inguinal hernia and the like. Besides, elasticized fabrics are advantageous for making general-purpose gloves, as well as covers for sofas, armchairs and chairs, since rounded covers can be manufactured therefrom.

The features of an elasticized fabric depend on the high elasticity of the elasticized yarn used to make them. Methods are known to obtain elasticized yarns in which an inextensible yarn is arranged about a core comprising an elastic fibre.

For instance, documents WO 2008/130563 A1 and WO 2012/062480 A2 describe ring spun elastic composite yarns, in which an elastic core fibre is surrounded by a fibrous sheath consisting of a mass of synthetic or natural spun staple fibres, for instance cotton fibres. An inelastic filament, for example a polyester or polyamide or polyolefin filament, is arranged near the elastic core fibre, in order to improve the elastic recovery properties of the elasticized yarn obtained therefrom. This way, permanent or long-lasting deformation can be prevented in such article portions as tight elbow or knee garment portions, in particular, when the joints have been flexed and then extended.

In order to obtain a favourable trade-off between elastic elongation and low shrinkage properties, according to WO 2008/130563 A1 the yarn is spun maintaining predetermined stretch ratios of the elastic fibre and of the inelastic filament. On the contrary, according to WO 2012/062480 A2, the elastic fibre and the inelastic filament are connected to each other in a plurality of points, and the inelastic filament is made of polyester, in particular in a polyester copolymer.

Other elasticized yarns are obtained using coil-forming machines. In this case, a substantially inextensible covering yarn is arranged as a helix about the elastic core. If such an elasticized yarn is stretched, the coils of the helix move away from one another. When the yarn is released, the coils and the helix tend to return to their previous configuration. This accounts for the elastic recovery of the yarn and of any fabric thereof.

Also these articles, manufactured from helicoidally wrapped yarns, suffer from the drawback that, when highly deformed, their elastic recovery is delayed and/or they are permanently deformed. This is the case, in particular, if the covering yarn is stiff, for example a linen, ramié, hemp, jute, bamboo yarn or the like. In this case, high friction occurs between the coils of the rigid covering yarn and the core elastic fibre.

In particular, WO2012/056436 discloses elasticized yarns in which the covering yarn comprises such a stiff material as linen, hemp or ramiè, and the number of coils per length unit of the elasticized yarn is set within a predetermined range. In particular, the number of coils per length unit of the elasticized yarn is larger than a minimum value that depends on the linear mass density of the covering yarn. This prevents the so-called "orange skin" defect, i.e., small masses of material randomly arranged on the fabric surface.

US 2004/128973 A1 discloses a composite twist yarn produced by arranging a twisted spun yarn and at least one filament parallel to each other, and twisting them together in a direction reverse to the twisted direction of the spun yarn over an untwisted point of the spun yarn so that the twisted direction of the composite twist yarn is substantially the same as the spun yarn, until the number of twists of the composite twist yarn is larger than that of the spun yarn.

JP2008297646 (A) discloses a composite core spun yarn, with a core made of a piled yarn including at least two filament yarns and a sheath made of staple fibres. Preferably, the composite spun yarn is produced by doubling a piled yarn of at least two filament yarns with staple fibres and twisting them in a direction reverse to the twisting direction of the piled yarn.

SUMMARY OF THE INVENTION

Therefore, the present invention aims at providing a manufacture method for an elastic core yarn, in which a covering yarn made of a natural material, in particular such a stiff material as linen, ramiè, hemp, jute or bamboo, is wound about a core in which, besides the elastic fibre an accompanying filament is introduced to modify the elastic properties of the elastic fibre, so that the elasticized fabrics made of this elastic core yarn, returns to an undeformed configuration without any significant delay or permanent deformation, after being stretched and then released.

It is a particular feature of the invention to provide such a manufacture method by which an elastic core yarn can be produced such that the accompanying filament does not protrude out of the helix through the coil of the covering yarn, when the elastic core yarn is stretched and then released, so as to preserve the elastic properties and the aspect of the fabrics made therefrom.

It is also particular feature of the invention to provide such a manufacture method by which an elastic core yarn can be produced from which fabrics can be made with no "orange skin" defect.

It is also a feature of the invention to provide an elasticized yarn and an elasticized fabric having the above indicated features.

These and other objects are achieved by a method and by an elasticized yarn and a fabric as defined by attached claims.

In the description, the expression "metric count" is used to mean a unit of yarn linear density, which is the length, expressed in kilometres, of 1 Kg of yarn. Accordingly, the metric count is expressed in km/kg. An alternative yarn count measurement unit is tex, which is, inversely, the mass expressed in grams of 1 km of yarn, or a submultiple of it, such as dtex (decitex). In particular, metric count Nm of the inextensible yarn is between 2 and 80.

In the description, the expression "number of torsions" or "of windings per metre" means the number of torsions that can be directly counted as the number of inverse torsions that is required for completely removing the windings on a predetermined length of a twisted yarn that has been arranged between two fixed points at a predetermined initial tensile stretch. In particular, the predetermined length and the initial tensile stretch are selected according to ISO 2061.

More in detail, a method for making an elastic core yarn include the steps of:

providing a core comprising:

an elastic fibre;

a continuous yarn arranged along the elastic fibre;

providing a covering yarn made of a natural fibre, said covering yarn having a linear mass density Nm, wherein the covering yarn is twisted with an initial twist direction selected between "Z" and "S";

conveying the core towards a collection bobbin, causing the core to pass through a wrapping space;

conveying the covering yarn in the wrapping space, the steps of conveying the core and the covering yarn taking place at respective conveying speeds;

helically wrapping with the covering yarn the core in the wrapping space, obtaining the elastic core yarn consisting of the core helically wrapped with the covering yarn;

collecting the elastic core yarn on the collection bobbin, wherein the speeds of conveying the core and the covering yarn are selected in such a way that, in the step of helically wrapping:

the covering yarn becomes twisted with a final twist direction opposite to the initial twist direction, i.e., selected between "S" and "Z", respectively;

a coil number T of covering yarn, larger than a predetermined minimum value $T_0$, and depending on its linear mass density Nm, is wound about one length unit of the elastic core yarn, wherein the wrapping space is a space enclosed in a container.

In the description, the expression "natural fibre" means a fibre obtained from such a material as cotton, wool, silk and so on, in particular the covering yarn can be made of a stiff natural material such as linen; hemp; ramié; bamboo; jute; a combination thereof.

This way, the core remains untwisted while the covering yarn is being wrapped about it. This is advantageous, since a sliding is admitted relatively between the core and the covering yarn wrapping the core, in order to avoid the defects of the fabrics made with the elastic core yarn, namely, the "orange skin" and permanent or long-lasting deformation defects of the fabric.

With respect to other yarn made according to the prior art, namely US 2004/128973 A1 or JP2008297646 (A), in which the core is twisted along with other yarn(s), and therefore no relative sliding is possible, with the invention such sliding is admitted, avoiding the above defects.

Before wrapping, the covering yarn as provided can initially have a "Z" twist direction, as it is normally available on the market. Then, the step of wrapping the core with the covering yarn is carried out by helically winding the covering yarn about the core, for instance, by a method using a hollow spindle. The helix direction is selected opposite to the initial twist direction of the covering yarn. In this case, during the step of wrapping, initially, the number of "Z" twists per metre decreases down to crossing the zero. Subsequently, the covering yarn takes "S" twists, i.e., it becomes twisted in a twist direction that is opposite to the initial twist direction. Of course, the same applies, mutatis mutandis, to the case where the covering yarn is initially "S"-twisted and finally becomes "Z"-twisted.

This way, during the wrapping step, the absolute number of twists per metre, i.e., regardless the twist direction, initially decreases down to an untwisted configuration, and then increases again (in the opposite direction). If, on the contrary, the step of wrapping were carried out in the same helix direction as the initial twist direction of the covering yarn as provided, the absolute number of twists would always increase during the whole wrapping step, and it could become too high, i.e., it could cause excessive internal stress in the covering yarn, which would become fragile, or even cause the covering yarn to break during the step of wrapping itself.

For example, if a Nm 26 flax yarn having about 400 "Z"-twists per metre is used as the covering yarn;

a 156 dtex, 3.4 stretch ratio elastomer is used along with a 55 dtex T400 continuous yarn as the elastic core, to make an elastic core yarn having 1100 coils per metre by the method according to the invention, the initial 400 "Z"-twists per metre of the covering yarn would progressively decrease in the first part of the wrapping step, crossing a zero-twist condition, and at the same time 400 coils of the covering yarn per metre are formed about the core. Subsequently, further 700 coils of covering yarn per metre are formed, i.e., the target total number of 1100 coils per meter is reached, while the covering yarn becomes "S"-twisted and the number of its "S" twists increases up to 700, which is considered a limit value for the twists per meter that can be tolerated by a Nm 26 linen yarn.

On the contrary, if the wrapping step were carried out in the direction opposite to the decreasing direction of the invention, i.e., if the helically wrapping step were carried out by increasing the "Z" twists of the covering yarn, after forming only 300 coils of covering yarn about the core, which is far lower than the target value of 1100, the covering yarn would achieve the limit value of 400+300=700 twist per meter. In other words, the covering yarn would achieve this limit value, but the core would not be coated enough to provide such advantages as a quick and substantially complete elastic return and an absence of the "orange skin" defect.

Therefore, the process according to the invention makes it possible to form a larger number of coils per length unit of the elastic core yarn, without reaching or excessively approaching a limit value beyond which the covering yarn can become fragile or even break due to the excessive absolute number of twists per metre. This is particularly important for such stiff materials as linen, hemp, or the like, since this limit value is lower than in the case of other conventional natural fibres.

The process according to the invention allows therefore to reach a large number of coils per length unit of the elastic core yarn product. The coils have therefore a very tight arrangement, which obliges the coils to return to their initial configuration and relative position once the elastic core yarn has been stretched and then released. This is possible even if the elastic core yarn comprises such a stiff material as linen, hemp, jute, bamboo or the like. This way, the continuous yarn of the core does not protrude out of the covering yarn through the coils thereof, which would remarkably deteriorate the aspect and the mechanical features of any fabric made with the elastic core yarn.

Therefore, the invention makes it possible to successfully product elastic core yarns in which the elastic core comprises a continuous yarn in addition to the elastic yarn, even if the covering yarn comprises such a stiff material as linen, hemp, ramié, jute, bamboo, or the like.

The feature of having an untwisted core comprising a continuous yarn remarkably reduces the friction between the coils of the stiff covering yarn and the elastic fibre. This way, the elastic recovery of the wrapping coils is improved, and therefore the problem of the permanent or long-lasting deformation of conventionally manufactured fabric portions made of linen and other rigid materials is solved. Therefore, when a fabric made with the elastic core yarn of the invention is stretched and then released, which is the case, for instance, for tight elbow or knee garment portions, when these joints are flexed and then extended, no defects occur any longer.

The closed wrapping space according to the invention, i.e., the wrapping space enclosed in a container, provides a solution to the following problem. As described above, in the method according to the invention, the covering yarn loses the initial twists, and then is twisted in an opposite direction. Therefore, an intermediate zero-twist condition is crossed in which the natural discontinuous fibres of the elastic core yarn are untwisted, i.e., substantially parallel to one another. This is diagrammatically shown in FIG. 1, right side. In this condition, the cohesion between the fibres of the covering yarn is very poor or does not exist at all. In fact, as well known, the cohesion between the discontinuous fibres and therefore the mechanical resistance of a yarn is primarily assured by the twisting of the fibres about one another. A risk exist therefore that the covering yarn breaks when the zero-twist condition occurs, due, in particular, to friction with the air surrounding the covering yarn where the latter in the zero-twist condition. Therefore, by protecting the wrapping space, the air surrounding the covering yarn while being wrapped about the core is less likely to become turbulent, and the friction between the temporarily untwisted portion of the covering yarn and the air is limited, in any case not strong enough to cause any breakup of the temporarily untwisted portion of the covering yarn.

In a possible embodiment, the step of providing the core includes steps of mounting a first spool of the elastic fibre and a second spool of the continuous yarn on a hollow spindle machine, while the step of providing the covering yarn includes a step of mounting a third spool of the covering yarn coaxially to a hollow cylindrical body of the hollow spindle machine. The step of conveying the core comprises a step of stretching and unwinding the same, at a predetermined unwinding speed that is the same as the conveying speed of the elastic fibre and of the continuous yarn from the first spool and from the second spool, respectively, by means of a friction wheel to which the elastic fibre and the continuous yarn, before conveying them to a central recess of a rotating hollow cylindrical body. The step of conveying the core can also comprise a step of stretching the core now wrapped with the covering yarn at the outlet of an orifice, and a step of collecting the elastic core yarn on a fourth spool or collection bobbin, at such a collecting speed to cause a predetermined stretch ratio of the elastic fibre.

The above-described method can be actuated by a well-known hollow-spindle machine to, such as a Hamel type hollow-spindle machine providing a protected wrapping space enclosed in a container.

In particular, the predetermined minimum value $T_0$, for any value of the linear mass density Nm indicated in a respective line of the table 1 is value $T_0$ written in the same line of table 1; for values lying between two adjacent linear mass density Nm values given in respective contiguous lines of table 1, the minimum value $T_0$ is obtained by linearly interpolating the values $T_0$ written in the same contiguous lines of table 1. With this number of coils can be obtained a coil arrangement tight enough to allow a substantially immediate and complete elastic recovery of the elastic core yarn. This way, the accompanying filament of the core is prevented from protruding out of the helix through the coil of the covering yarn, when the elastic core yarn is stretched and then released. This would deteriorate the elastic properties and the aspect of the fabric manufactured from the elastic core yarn, when in use.

In particular, the coil number T per length unit of the elastic core yarn is lower than a maximum value $T_1$; for each linear mass density value Nm indicated in a respective line of table 2, this minimum value is the value $T_1$ written in the same line of table 2; for values lying between two adjacent linear mass density Nm values given in respective contiguous lines of table 2, the maximum value $T_1$ can be obtained by linearly interpolating the values $T_1$ written in the same contiguous lines of table 2. This makes it possible to obtain a not too stiff elastic core yarn, which would be the case if the coils were arranged too tight beside one another.

Advantageously, the coil number T per length unit of the elastic core yarn, for any value of the linear mass density Nm, is provided by the equations:

$$T_1=K_1N_m^{0.42}, \text{ if } N_m<20 \text{ km/kg};$$

$$T_1=K_2N_m^{0.42}, \text{ if } N_m\geq 20 \text{ km/kg},$$

where $K_1$ is a number set between 82 and 348 and $K_2$ is a number set between 118 and 308. Preferably, $K_1$ is a number set between 120 and 240. More preferably, $K_2$ is a number set between 140 and 220.

Most preferably, the coil number T per length unit of the elastic core yarn is set between −10% and +10% of a reference value $T_2$; for each linear mass density value Nm indicated in a respective line of table 3,

TABLE 1

| $N_m$ | $T_0$ |
|---|---|
| 2 | 0 |
| 3, 5 | 50 |
| 7 | 150 |
| 10 | 200 |
| 15 | 250 |
| 20 | 350 |
| 24 | 400 |
| 26 | 450 |
| 30 | 470 |
| 35 | 490 |
| 40 | 520 |
| 45 | 540 |
| 50 | 600 |
| 60 | 650 |
| 70 | 700 |

TABLE 2

| $N_m$ | $T_1$ |
|---|---|
| 2 | 500 |
| 3, 5 | 750 |
| 7 | 900 |
| 10 | 1000 |
| 15 | 1130 |
| 20 | 1200 |
| 24 | 1250 |
| 26 | 1300 |
| 30 | 1350 |

TABLE 2-continued

| $N_m$ | $T_1$ |
|---|---|
| 35 | 1450 |
| 40 | 1500 |
| 45 | 1550 |
| 50 | 1620 |
| 60 | 1720 |
| 70 | 1850 |

TABLE 3

| $N_m$ | $T_2$ |
|---|---|
| 2 | 100 |
| 3, 5 | 200 |
| 7 | 400 |
| 10 | 500 |
| 15 | 650 |
| 20 | 730 |
| 24 | 800 |
| 26 | 820 |
| 30 | 850 |
| 35 | 900 |
| 40 | 950 |
| 45 | 1000 |
| 50 | 1050 |
| 60 | 1100 |
| 70 | 1150 |

this reference value is the $T_2$ value written in the same line of table 3; for values lying between two adjacent linear mass density Nm values given in respective contiguous lines of table 3, the reference value $T_2$ can be obtained by linearly interpolating the values $T_2$ written in the same contiguous lines of table 3.

Advantageously, the steps of conveying the core and the covering yarn comprise:

steps of causing the core and the covering yarn to travel through a longitudinal through cavity and along a lateral surface, respectively, of a rotating hollow cylindrical body turning at a predetermined rotation speed, the longitudinal through cavity having an inlet end and an outlet end opposite to each other for the core, a step of causing the core and the covering yarn to pass through an orifice facing the outlet end of the longitudinal through cavity of the rotating hollow cylindrical body at a predetermined distance therefrom, and wherein the wrapping space, where the covering yarn and the core are mounted to each other, is set between the outlet and the orifice, so that the container has an opening at the orifice, and the core and the covering yarn carry out the step to pass as the elastic core yarn.

The elastic fibre can be made of a synthetic elastomeric material having a linear mass density set between 22 dtex and 940 dtex. In particular, the linear mass density is selected among 22, 44, 78, 100, 156, 310, 470, 620, 940 dtex. In particular, the elastomeric material is selected from the group comprised of a polyurethane and a polyether-polyurea copolymer. For example, the elastic fibre can comprise at least the 85% of segmented polyurethane. In particular, the synthetic elastomeric fibre can be a fibre commercially known as Lycra® or Elastan®.

Preferably, the step of conveying the elastic fibre is carried out by stretching the elastic fibre according to a stretch ratio between 2 and 7, i.e., up to 2 to 7 times its length n a natural (non-stretched) state. In the case of a Lycra® 156 dtex elastic fibre, the stretch ratio is about 3.4.

As an alternative, the elastic fibre can be a natural rubber fibre having a linear mass density set between 22 dtex and 1300 dtex.

Preferably, the continuous yarn is made of a material selected from the group comprised of:

a polyamide;

a polyester, in particular the polyester can be selected among polyethylene terephthalate, polytrimethylene terephthalate, polybutylene terephthalate, and a combination thereof, in particular a combination of polyethylene terephthalate and polytrimethylene terephthalate commercially known as T400;

a ultra-high molecular weight polyethylene;

a combination thereof, wherein the continuous yarn can be a wire continues to at least one bave, said filaments textured or smooth.

The continuous yarn, in particular a T400 yarn, can have a linear mass density set between 22 dtex and 660 dtex. In particular, the linear mass density is selected among 22, 44, 83, 167, 330, 660 dtex.

The continuous yarn can have a parallel arrangement along the elastic fibre, i.e., it can be arranged parallel to the elastic fibre.

As an alternative, the continuous yarn can have an interconnected arrangement along the elastic fibre, i.e., it can have connection points to the elastic fibre at predetermined distances from one another.

As an alternative, the continuous yarn can have a wrapped arrangement, where the continuous yarn forms a covering about the elastic fibre.

It falls within the scope of the invention also an elasticized yarn obtained in the way above described, as well as a elasticized fabric containing at least one part of elasticized yarn above described obtained in the way above described.

BRIEF DESCRIPTION OF THE DRAWINGS

The invention will be now shown with the following description of exemplary embodiments and examples thereof, exemplifying but not limitative, with reference to the attached drawings, in which.

DESCRIPTION OF PREFERRED EXEMPLARY EMBODIMENTS

Figure 1:
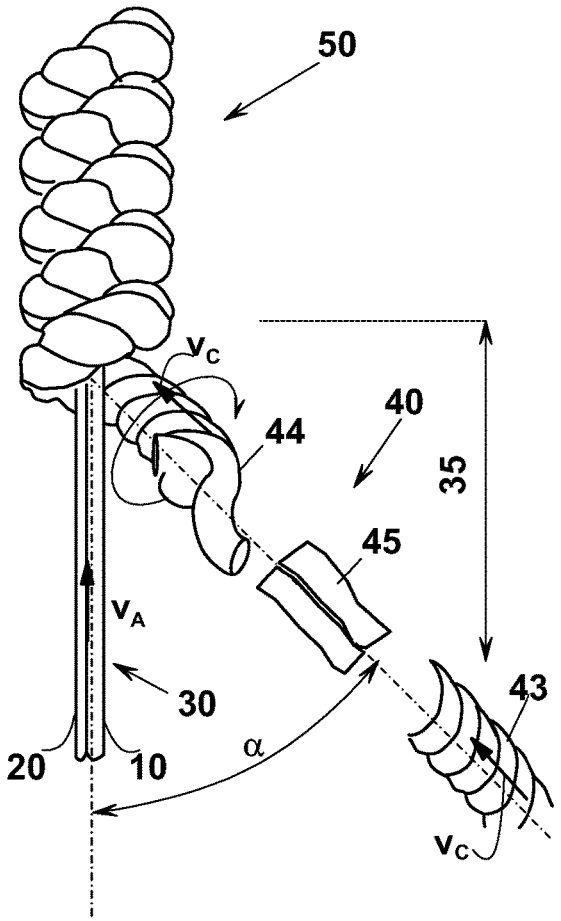
FIG. 1 diagrammatically shows a step of helically wrapping the covering yarn about the core, in order to obtain an elastic core yarn.

With reference to FIG. 1, a method is described for making an elastic core yarn 50, in which an elastic core 30 is coated by a covering yarn 40 consisting of a natural fibre. Elastic core 30 includes an elastic fibre 10 and a continuous yarn 20 arranged along elastic fibre 10, while covering yarn 40 is made of a natural fibre and is twisted with an initial twist direction 43 that may be "Z" or "S", but is typically "Z", i.e., as normally available on the market, as depicted in FIG. 1.

In order to obtain elastic core yarn 50, a step is performed of covering, i.e., helically wrapping covering yarn 40 about core 30. To this purpose, steps are carried out of conveying core 30 and covering yarn 40, at respective speeds $v_A$, $v_C$. Core 30 is conveyed towards a collecting bobbin 51 through a wrapping space 35, and covering yarn 40 is conveyed in wrapping space 35, where it reaches core 30 laterally, i.e., tangentially, according to a predetermined angle $\alpha$ between the direction of core 30 and the direction of covering yarn 40, in order to form a substantially helical covering about core 30.

Figure 2:
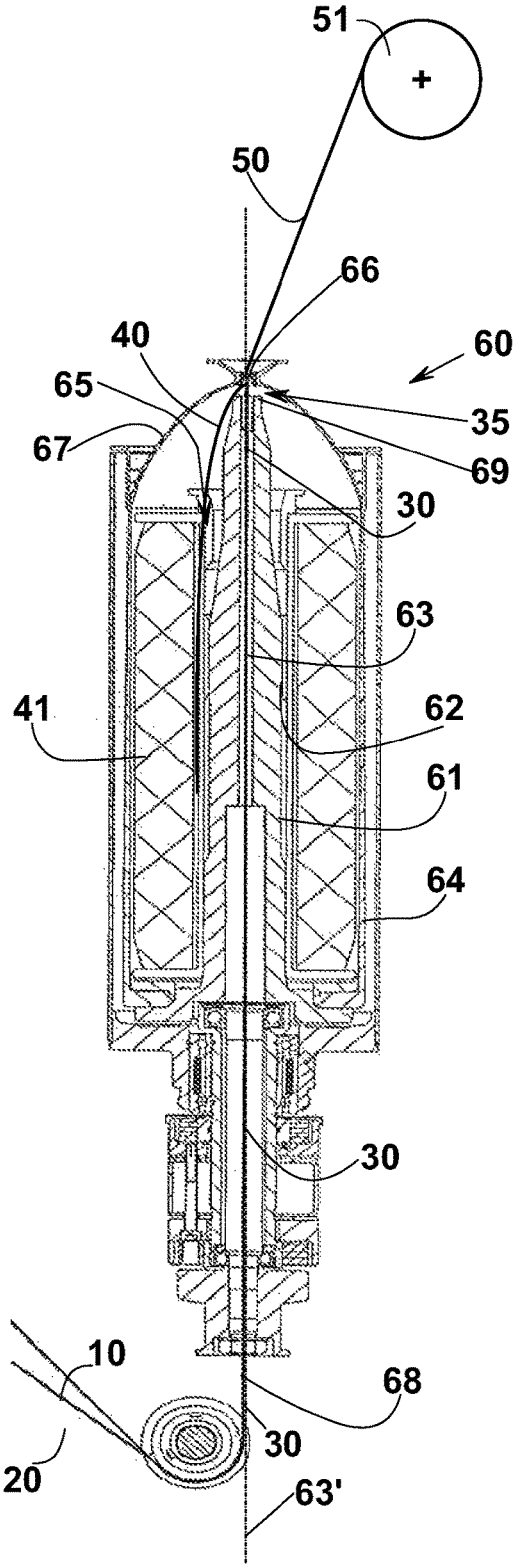
FIG. 2 diagrammatically shows an elastic core yarn production equipment configured to carry out the method according to the invention.

As shown in FIG. 2, the steps of conveying core 30 and covering yarn 40 are controlled by the speed at which elastic core yarn 50 is collected on collecting bobbin 51, while elastic fibre 10, continuous yarn 20 and covering yarn 40 are withdrawn from respective spools, not shown and 41, respectively.

In an exemplary embodiment, before reaching wrapping space 35, core 30 passes through a central recess i.e., longitudinal through cavity 63 of a first cylindrical body 61 turning at a predetermined high speed about its own axis 63', said longitudinal through cavity 63 having an inlet end 68 and an outlet end 69 opposite to each other. In other words, core 30 follows a substantially linear path. On the contrary, covering yarn 40 is conveyed along an outer surface 62 of first cylindrical body 61, preferably along a guide arranged thereon. Preferably, first cylindrical body 61 is integrally and coaxially housed in a second hollow cylindrical body 64, cylindrical bodies 61,64 forming a conveying unit 60. Bobbin 41 of covering yarn 40 is fixed inside second cylindrical body 64, therefore covering yarn 40 is conveyed through a gap 65 between bobbin 41 and the outer surface of first cylindrical body 61.

In this exemplary embodiment, wrapping space 35 is defined between the outlet end 69 of first cylindrical body 61, at which core 30 enters into wrapping space 35, and an orifice 66, preferably arranged on axis 63', through which elastic core yarn 50 leaves wrapping space 35 and is drawn to collecting bobbin 51. Container or wall 67 enclosing wrapping space 35 is preferably axisymmetric and converges from the inner surface of second hollow cylindrical body 64 to orifice 66.

The direction of the rotation of conveying unit 60 is selected so that the sense of the helix is opposite to the initial twist direction 43 of covering yarn 40 and therefore covering yarn 40 becomes twisted with a final twist direction 44, e.g. "S", opposite to the initial twist direction 43, e.g. "Z", in the step of helically wrapping core 30. During the wrapping step, the absolute number of twists per metre of covering yarn 40 initially decreases down to an untwisted configuration 45, and then increases again in the opposite direction.

Conveying speeds of core 30 and covering yarn 40, as well as the rotation speed of conveying unit 60 are selected so that a number of coils T of covering wrapper 40 is wound on each length unit of elastic core yarn 50 as manufactured, the number T being larger than a predetermined minimum value $T_0$ that depends on the linear mass density Nm of covering yarn 40.

Wrapping space 35 is enclosed in a container 67, in order to avoid friction between free air, on the one hand, and the conveyed materials, and elastic core yarn 50 being formed, on the other hand. As discussed above, covering yarn 40 would lose its consistence, and could even break, while turning from initial twist direction 43 to opposite final twist direction 44.

In particular, the material of covering yarn 40 is a stiff material, for example one among linen, hemp, ramié, bamboo, jute, or a combination thereof.

Figure 3:
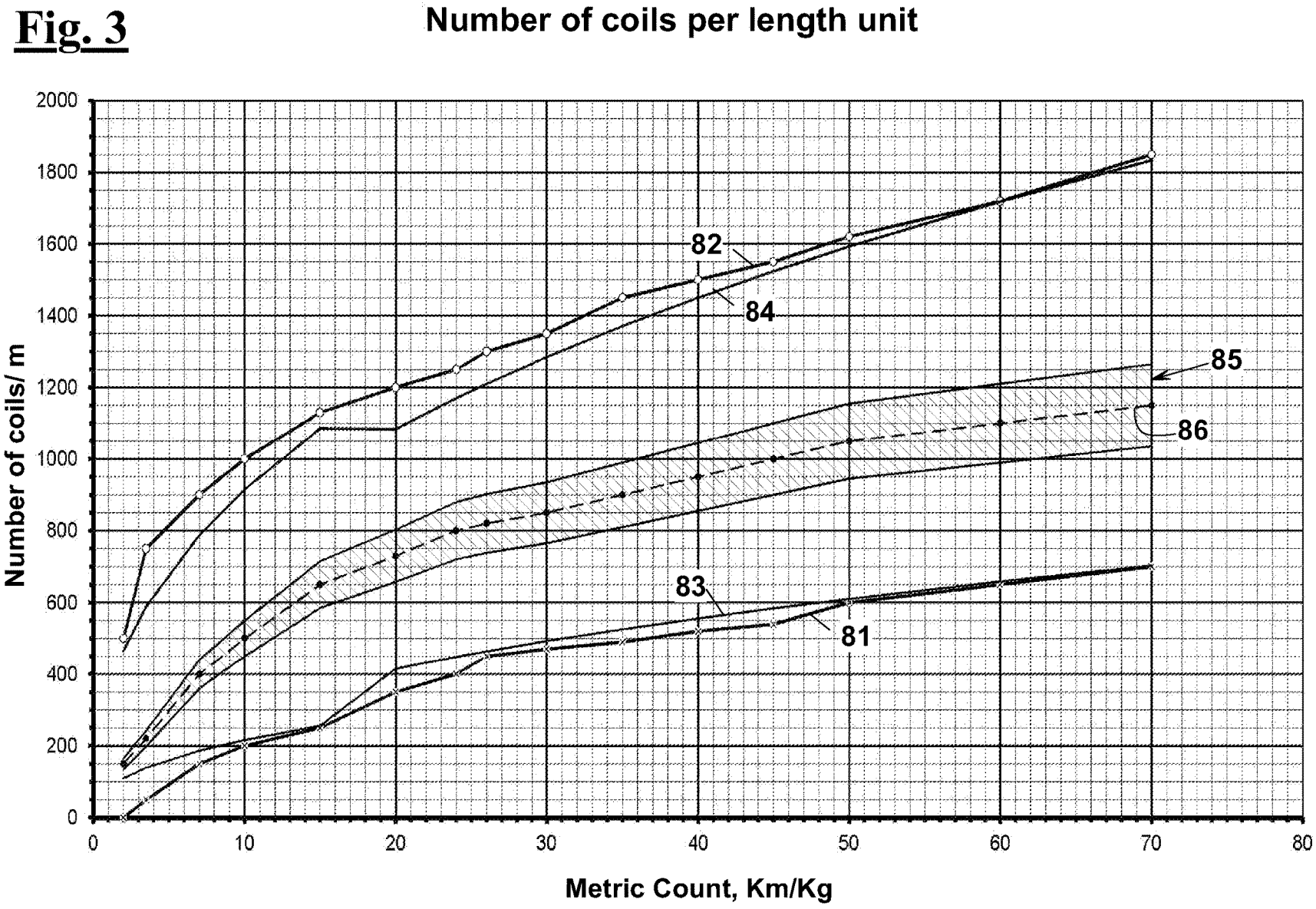
FIG. 3 is a diagram showing the minimum, maximum and reference numbers of coils per length unit of the elastic core yarn, and how these numbers change depending on the linear mass density of the covering yarn.

FIG. 3 is a diagram showing the predetermined minimum value $T_0$ of the coils that must be wrapped per length unit of elastic core yarn 50, for any value of linear mass density Nm of covering yarn 40, as a curve 81. Curve 81 is obtained by interpolating the values of table 1, described above.

The diagram of FIG. 3 also shows a curve 82 indicating, for any value of linear mass density Nm of covering yarn 40, a maximum coil number $T_1$ that should not be exceeded in order to obtain good elastic properties of elastic core yarn 50, as experience has shown. Curve 82 is obtained by interpolating the values of table 2, described above.

Advantageously, the coil number T per length unit of elastic core yarn 50, for any value of the linear mass density Nm of covering yarn 40, is provided by the equations:

$$T_1=K_1N_m^{0.42}, \text{ if } N_m<20 \text{ km/kg};$$

$$T_1=K_2N_m^{0.42}, \text{ if } N_m\geq 20 \text{ km/kg},$$

where $K_1$ and $K_2$ can range between a minimum value, respectively 82 and 118, and a maximum value, respectively 308 and 348. Curves 83 and 84 corresponds to the couples of values $(K_1,K_2)=(82,118)$ and $(K_1,K_2)=(308,348)$, respectively. Preferably, $K_1$ is set between 120 and 240, and $K_2$ is set between 140 and 220.

The diagram of FIG. 3 also shows a band 85 corresponding to preferred values of number of coils T per length unit of elastic core yarn 50. For any value of the linear mass density Nm, these preferred values are set between ±10% a central reference value $T_2$ that is obtained by interpolating the values of table 3, corresponding to curve 86.

In some exemplary embodiments, elastic fibre 10 of core 30 is a natural rubber fibre having linear mass density Nm set between 22 dtex and 1300 dtex.

In other exemplary embodiments, elastic fibre 10 of core 30 is a fibre made of a synthetic elastomeric material having linear mass density Nm set between 22 dtex and 940 dtex. In particular, linear mass density Nm can be selected among 22, 44, 78, 100, 156, 310, 470, 620 and 940 dtex. The elastomeric synthetic material is preferably a polyurethane or a polyether-polyurea copolymer.

Continuous yarn 20 can be a polyamide yarn, or a polyester such as polyethylene terephthalate, polybutylene terephthalate, and polytrimethylene terephthalate. In this case, continuous yarn 20 can be made of a single polyester or of a combination of these polyesters, in particular a combination of polyethylene terephthalate and polytrimethylene terephthalate commercially known as "T400".

Such a combination of polyethylene terephthalate and polytrimethylene terephthalate used to make continuous yarn 20 has preferably a linear mass density Nm set between 22 dtex and 660 dtex, in particular, linear mass density Nm is selected among 22, 44, 83, 167, 330, 660 dtex As an alternative, continuous yarn 20 can be an ultra-high molecular weight polyethylene yarn. Finally, continuous yarn 20 can comprise any combination of the above-mentioned materials. Each of these yarns can be smooth or texturized.

Moreover, even if the FIG. 1 shows a substantially parallel arrangement of continuous yarn 20 and elastic fibre 10, this is not a limitation. On the contrary, a wrapped arrangement is also possible, in which continuous yarn 20 forms a covering about elastic fibre 10, and/or a interconnected arrangement, in which elastic fibre 10 and continuous yarn 20 are mutually connected in connection points at predetermined distances from one another.

It falls within the scope of the invention also an elastic core yarn 50 obtained through the method described above, as well as an elasticized fabric, not shown, made at least in part at least of elastic core yarn 50 obtained through the method described above. More in detail, elastic core yarn 50 can be used for either warp or weft yarn.

The foregoing description of embodiments and of examples of the invention, and of the way of using the apparatus, will so fully reveal the invention according to the conceptual point of view, so that others, by applying current knowledge, will be able to modify and/or adapt for various applications such embodiment without further research and without parting from the invention, and, then it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and, therefore, not of limitation.

The invention claimed is:

1. A method for making an elastic core yarn comprising the steps of:

providing a core comprising:

an elastic fibre; and a continuous yarn arranged along said elastic fibre;

providing a covering yarn made of a natural fibre, said covering yarn having a linear mass density Nm, said covering yarn twisted with an initial twist direction selected between "Z" and "S" and with an initial number of twists per meter;

conveying said core towards a collecting bobbin, causing said core to pass through a wrapping space;

conveying said covering yarn in said wrapping space;

said steps of conveying said core and said covering yarn taking place at respective conveying speeds, helically wrapping said core with said covering yarn in said wrapping space, obtaining said elastic core yarn consisting of said core wrapped by a helix of said covering yarn; and collecting said elastic core yarn on said collecting bobbin, wherein said step of helically wrapping provides:

causing said number of twists per meter of said covering yarn to decrease from said initial number of twists per meter to an untwisted condition and afterwards to increase in a direction opposite to the initial twist direction, such that said covering yarn becomes twisted with a final twist direction "S" or "Z" opposite to said initial twist direction "Z" or "S"; and selecting said conveying speeds in order to cause a coil number T of coils, of said helix of said covering yarn wound about one length unit of said elastic core yarn, to be larger than a predetermined minimum value $T_0$ which depends upon said linear mass density Nm, and wherein said wrapping space is a space enclosed in a container.

2. The method according to claim 1, wherein said covering yarn is selected from the group consisting of:

a linen yarn;

a hemp yarn;

a ramié yarn;

a bamboo yarn;

a jute yarn; and a combination thereof.

3. The method according to claim 2, wherein said predetermined minimum value $T_0$, for any value of said linear mass density Nm indicated in a respective line of the following table:

| $N_m$ | $T_0$ |
|---|---|
| 2 | 0 |
| 3, 5 | 50 |
| 7 | 150 |
| 10 | 200 |
| 15 | 250 |
| 20 | 350 |
| 24 | 400 |
| 26 | 450 |
| 30 | 470 |
| 35 | 490 |
| 40 | 520 |
| 45 | 540 |
| 50 | 600 |
| 60 | 650 |
| 70 | 700 |

is the value $T_0$ written in said respective line of said table, and for values of said linear mass density Nm intermediate between two values indicated in respective contiguous lines of said table, said minimum value $T_0$ is obtained by linearly interpolating the values $T_0$ written in said respective contiguous lines of said table.

4. The method according to claim 2, wherein said coil number T per length unit of said elastic core yarn is lower than a maximum value $T_1$, wherein said maximum value $T_1$, for any value of said linear mass density Nm indicated in a respective line of the following table:

| $N_m$ | $T_1$ |
|---|---|
| 2 | 500 |
| 3, 5 | 750 |
| 7 | 900 |
| 10 | 1000 |
| 15 | 1130 |
| 20 | 1200 |
| 24 | 1250 |
| 26 | 1300 |
| 30 | 1350 |
| 35 | 1450 |
| 40 | 1500 |
| 45 | 1550 |
| 50 | 1620 |
| 60 | 1720 |
| 70 | 1850 |

is equal to value $T_1$ written in said respective line of said table, and for values of said linear mass density Nm intermediate between values indicated in respective contiguous lines of said table, said maximum value $T_1$ is obtained by linearly interpolating the values $T_1$ written in said respective contiguous lines of said table.

5. The method according to claim 2, wherein said coil number T per length unit, for any value of said linear mass density Nm, is provided by the equations:

$$T_1=K_1N_m^{0.42}, \text{ if } N_m<20 \text{ km/kg; and}$$

$$T_1=K_2N_m^{0.42}, \text{ if } N_m\geq 20 \text{ km/kg,}$$

where $K_1$ is a number set between 82 and 348 and $K_2$ is a number set between 118 and 308.

6. The method according to claim 5, wherein $K_1$ is set between 120 and 240.

7. The method according to claim 5, wherein $K_2$ is set between 140 and 220.

8. The method according to claim 1, wherein said steps of conveying said core and said covering yarn comprise:

steps of causing said core and said covering yarn to travel through a longitudinal through cavity and along a lateral surface, respectively, of a rotating hollow cylindrical body turning at a predetermined rotation speed, said longitudinal through cavity having an inlet end and an outlet end opposite to each other for said core; and a step of causing said core and said covering yarn to pass through an orifice facing said outlet end of said longitudinal through cavity of said rotating hollow cylindrical body at a predetermined distance therefrom, and wherein said wrapping space is located between said outlet and said orifice, so that said container has an opening at said orifice and said core and said covering yarn pass through said orifice as said elastic core yarn.

9. The method according to claim 1, wherein said elastic fibre is selected from the group consisting of:

a natural rubber fibre having a linear mass density set between 22 dtex and 1300 dtex; and a fibre of an elastomeric material having a linear mass density set between 22 dtex and 940 dtex.

10. The method according to claim 1, wherein said elastic fibre is a fibre of an elastomeric material having a linear mass density selected among 22, 44, 78, 100, 156, 310, 470, 620, 940 dtex.

11. The method according to claim 9, wherein said elastomeric material is selected from the group consisting of a polyurethane and a polyether-polyurea copolymer.

12. The method according to claim 1, wherein said continuous yarn is made of a material selected from the group consisting of:

a polyamide;

a polyester;

a ultra-high molecular weight polyethylene;

a combination thereof, wherein said continuous yarn is selected from the group comprised of: a continuous one-filament yarn and a continuous multi-filament yarn, said filaments textured or smooth.

13. The method according to claim 12, wherein said polyester is selected among:

polyethylene terephthalate;

polybutylene terephthalate;

polytrimethylene terephthalate; and a combination thereof.

14. The method according to claim 12, wherein said continuous yarn comprises a combination of polyethylene terephthalate and polytrimethylene terephthalate and has a linear mass density set between 22 dtex and 660 dtex.

15. The method according to claim 14, wherein said linear mass density is selected among 22, 44, 83, 167, 330, 660 dtex.

16. The method according to claim 1, wherein said continuous yarn has an arrangement along said elastic fibre selected from the group consisting of:

a parallel arrangement, wherein said continuous yarn is arranged parallel to said elastic fibre;

an interconnected arrangement, wherein said continuous yarn has connection points to said elastic fibre, said connection points at predetermined distances from one another;

a wrapped arrangement, wherein said continuous yarn forms a covering about said elastic fibre.

* * * * *